US007438003B2

(12) United States Patent
Wilfer

(10) Patent No.: US 7,438,003 B2
(45) **Date of Patent: *Oct. 21, 2008**

(54) BURNING CONTAINER

(76) Inventor: Ronald R. Wilfer, P.O. Box 38, Eagle River, WI (US) 54521

( * ) Notice: Subject to any disclaimer, the term of this patent is extended or adjusted under 35 U.S.C. 154(b) by 490 days.

This patent is subject to a terminal disclaimer.

(21) Appl. No.: 11/185,292

(22) Filed: Jul. 20, 2005

(65) Prior Publication Data

US 2005/0247297 A1 Nov. 10, 2005

Related U.S. Application Data

(63) Continuation-in-part of application No. 10/264,275, filed on Oct. 3, 2002, now Pat. No. 6,932,001.

(60) Provisional application No. 60/326,803, filed on Oct. 3, 2001.

(51) Int. Cl.
*F23G 5/00* (2006.01)
*F24C 1/16* (2006.01)

(52) U.S. Cl. ..... 110/241; 110/251; 110/224; 110/25 B; 110/9 R

(58) Field of Classification Search ..... 110/241, 110/251, 308, 314, 336; 126/222–225, 9 R, 126/77, 25 B, 59, 152; 220/485
See application file for complete search history.

(56) References Cited

U.S. PATENT DOCUMENTS

| | | | | |
|---|---|---|---|---|
| 459,892 | A | 9/1891 | Weir | |
| 568,393 | A | 9/1896 | Wilson | |
| 643,593 | A | 2/1900 | Cox | |
| 920,312 | A | 5/1909 | Fox | |
| 989,417 | A * | 4/1911 | Raggio | 110/217 |
| 1,536,220 | A | 5/1925 | Jouclard | |
| 2,535,206 | A | 12/1950 | Hathaway | |
| 2,936,724 | A * | 5/1960 | Bishop | 110/254 |
| 3,259,084 | A | 7/1966 | Hance | |
| 3,499,399 | A | 3/1970 | Kaufmann | |
| 5,134,990 | A | 8/1992 | Bradfield | |
| 5,347,935 | A | 9/1994 | Whitaker | |
| 5,596,980 | A | 1/1997 | Whalen et al. | |
| 5,915,371 | A | 6/1999 | Haring | |
| 6,119,679 | A * | 9/2000 | Galvin | 126/41 R |

* cited by examiner

*Primary Examiner*—Kenneth B Rinehart
(74) *Attorney, Agent, or Firm*—Michael Best & Friedrich LLP

(57) ABSTRACT

A burning device includes a plurality of interconnected chamber walls defining a burning chamber and a central axis, each chamber wall also defining a plurality of chamber apertures. A plurality of flanges extend radially from the chamber walls and substantially parallel to the central axis, and a plurality of circumferentially extending lips extending from a respective flange. Each lip is radially spaced apart from an associated chamber wall and defines therebetween an air flow passageway communicating with the burning chamber and affording air flow into the burning chamber. Ventilation apertures are defined in at least one of the plurality of lips and the plurality of flanges, the ventilation apertures providing communication between the air flow passageways and the burning chamber. A cover is removably supported by the chamber walls and defines a plurality of apertures.

11 Claims, 6 Drawing Sheets

BURNING CONTAINER

CROSS REFERENCE TO RELATED APPLICATION(S)

This application is a continuation-in-part of U.S. patent application Ser. No. 10/264,275 filed Oct. 3, 2002, now U.S. Pat. No. 6,932,001, which claims the benefit of priority to U.S. provisional Patent Application No. 60/326,803 filed Oct. 3, 2001.

BACKGROUND OF THE INVENTION

The invention relates to a container for burning material such as yard waste, paper products, coal, wood and other flammable material. In addition, the container may be used as a grill.

Burning refuse has long been an efficient method for reducing large amounts of debris into comparatively small piles of soot and ash. Burning refuse in this manner reduces the amount of material placed into landfills and offers certain environmental advantages associated with the reduction of waste volume. In order to prevent the fire associated with burning the refuse from spreading uncontrollably, it has long been known to place the items to be burned into a container such as a drum or barrel, thereby containing the fire within a small, easily controlled area. Oftentimes holes or other apertures are formed in the barrel to increase airflow through the barrel, thereby improving the barrel's burning characteristics. Currently used burning barrels and drums often result in offensive smoking and smoldering, which is a result of poor airflow through the container.

SUMMARY OF THE INVENTION

The present invention provides a burning device including a plurality of chamber walls that define a burning chamber and a central axis. Each chamber wall also defines a plurality of chamber apertures. A plurality of flanges extend radially from the chamber walls and substantially parallel to the central axis. A plurality of circumferentially extending lips extend from ends of respective flanges, and each lip is radially spaced apart from an associated chamber wall. The lips cooperate with the associated chamber wall to at least partially define an air flow passageway communicating with the burning chamber and affording air flow into the burning chamber. Ventilation apertures are defined in at least one of the plurality of lips and the plurality of flanges, the ventilation apertures providing communication between the air flow passageways and the burning chamber. A cover is removably supported by the chamber walls and defines a plurality of apertures.

The present invention also provides a burning device including a plurality of panels interconnected to define a burning chamber and a central axis, each panel defining a plurality of ventilation apertures and having a top edge and a bottom edge. A plurality of flanges are formed integrally with the panels and extend radially with respect thereto from the bottom edge to the top edge, and a plurality of lips are formed integrally with the panels, each lip extending generally circumferentially from a respective flange. A plurality of ventilation apertures are formed in at least one of the plurality of flanges and of the plurality of lips. The panels, the flanges, and the lips operate to define angularly spaced apart air flow passageways that extend axially through the chamber.

The present invention also provides a method for assembling a burning device. The method includes forming a plurality of chamber panels, each panel having a top edge, a bottom edge, a free edge, a flange edge, and a flange extending from the flange edge. Each chamber panel also defines a plurality of apertures. The free edge of a first chamber panel is coupled to the flange edge of a second chamber panel, and additional chamber panels are coupled to the first and second panels to define a burning chamber having a central axis. The method further includes coupling a generally annular support ring to the bottom edges of the chamber panels. A cover defining a plurality of apertures is positioned on the top edges of the panels to overlie the chamber, wherein the cover is positionable with respect to the panels in more than one position.

Other features of the invention will become apparent to those skilled in the art upon review of the following detailed description and the drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION OF THE PREFERRED EMBODIMENT

FIGS. 1-9 illustrate a burning container 20 embodying the invention and which is adapted for use to burn any number of materials. For example, the burning container 20 may be used as a cooking grill, an incinerator, a thermal shredder, a fireplace, or the like. Examples of fuel, or burning materials for the burning container 20 includes paper products, wood, yard refuse, coals, hickory or other burnable material.

Figure 1:
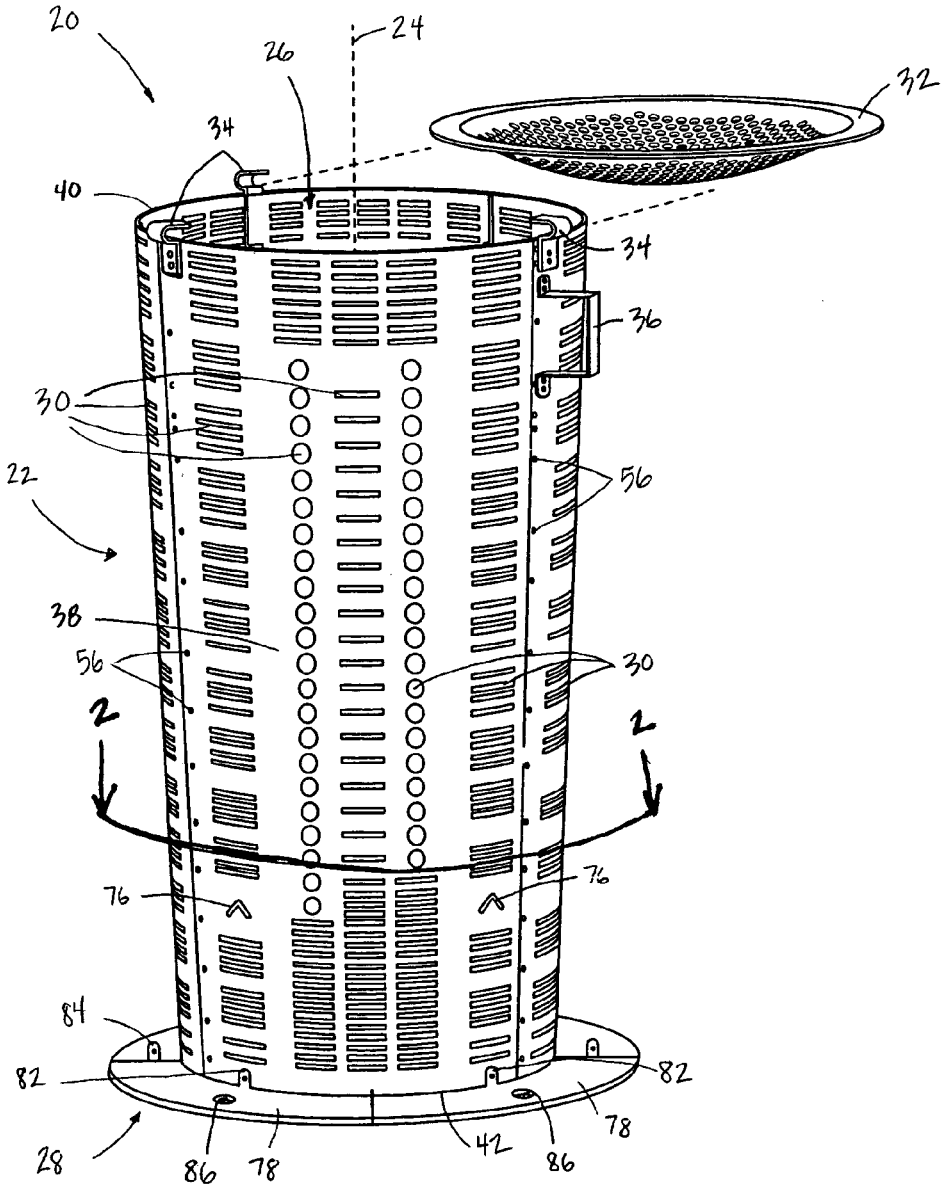
FIG. 1 is a perspective view of a burning container embodying the invention.

Referring to FIG. 1, the burning container 20 includes a cylindrical portion 22 having a central axis 24, and a burning chamber 26. The cylindrical portion 22 is supported by a base assembly 28 that is fixed to the cylindrical portion 22. The cylindrical portion 22 also includes a plurality of apertures 30 that afford ventilation along substantially the entire length of the cylindrical portion 22. The container 20 also includes a cover 32, cover hooks 34, and a handle 36.

Figure 2:
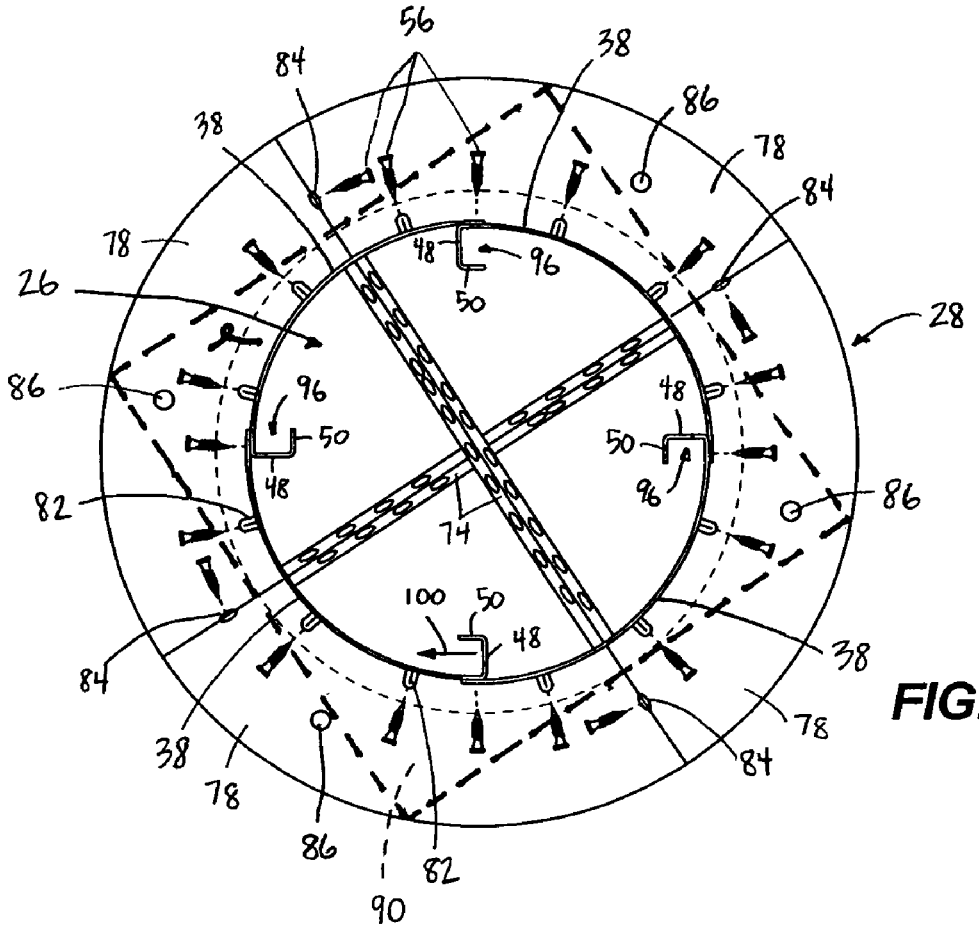
FIG. 2 is a section view taken along line 2-2 of FIG. 1.
Figure 3:
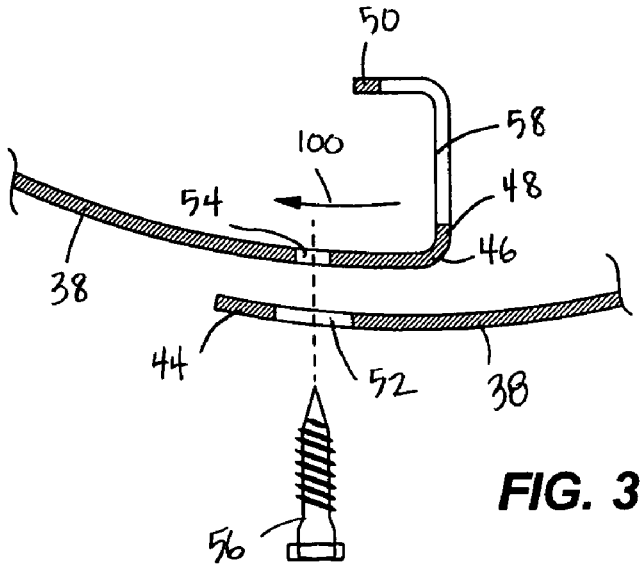
FIG. 3 is an enlarged exploded view of a portion of FIG. 2.
Figure 4:
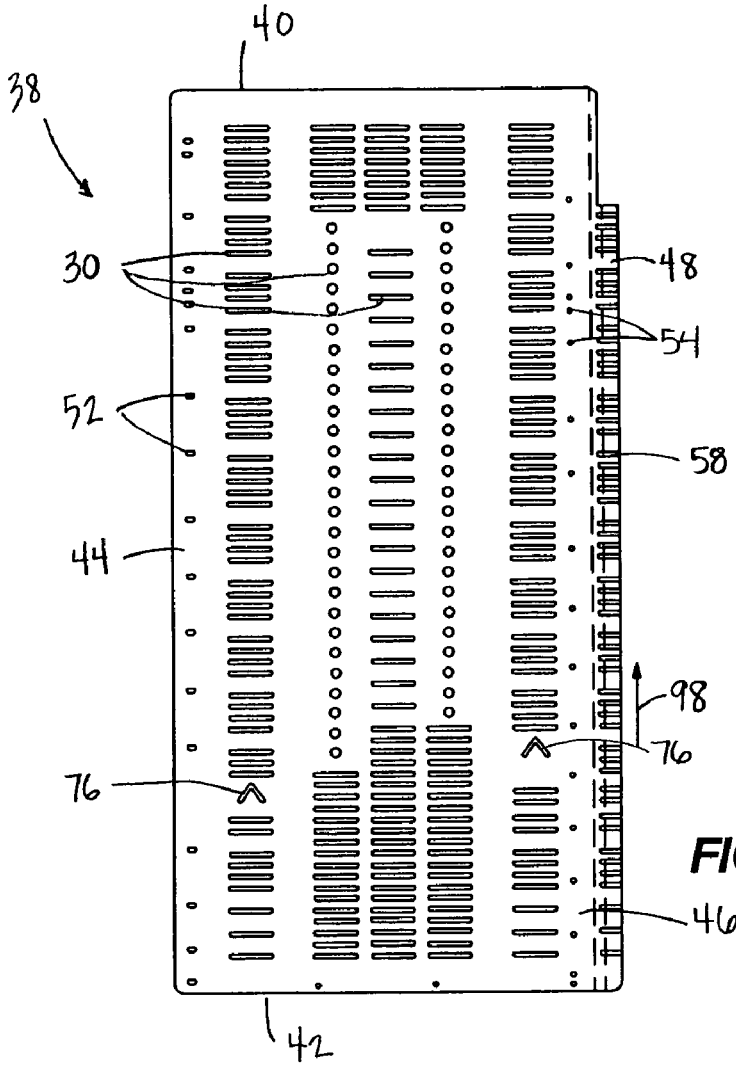
FIG. 4 is a side view of a portion of the burning container illustrated in FIG. 1.

Referring also to FIGS. 2-4, the cylindrical portion 22 includes a plurality of generally arcuate chamber panels 38 having formed therein the ventilation apertures 30. In the illustrated embodiment, four panels 38 are used to define the chamber walls of the burning chamber 26. Each panel 38 is similarly configured and includes a top edge 40, a bottom edge 42, a free edge 44, and a flange edge 46. A flange 48 extends radially from the flange edge 46 of each panel 38 and substantially parallel to the central axis 24. A lip 50 extends from the end of each flange 48 and is circumferentially extending. Each lip 50 is radially spaced apart from an associated panel 38. As seen in FIG. 4, top edges of the flange 48 and the lip 50 are recessed from the top edge 40 of the panel 38. The recess provides room for the cover 32 when attached to the burning container 20. In further embodiments, no recess is formed between the top edges of the flanges 48 and the lips 50 and the top edges of the panels 38.

A plurality of mounting slots 52 extend along the free edge 44 of each panel 38, and a plurality of corresponding mounting holes 54 extend along the flange edge 46 of each panel 38. The slots 52 and holes 54 are configured such that the panels 38 may be secured to each other by extending fasteners 56 through the mounting slots 52 of one panel 38 and into corresponding mounting holes 54 of an adjacent panel 38. For ease of assembly, the fasteners 56 are preferably of the self-tapping type, however other types of fasteners and other fastening methods are possible as well. Additional panels 38 are secured to one another in the manner described above until the plurality of panels 38 form a complete cylinder. When the panels 38 are assembled, the flanges 48 of each panel 38 extend generally radially inward toward the central axis 24, and the lips 50 of each panel 38 extend generally circumferentially with respect to the cylindrical portion 22. Although illustrated panels 38 are semi-cylindrical, in a further embodiment the panels 38 may be flat and define a polygonal structure in place of the illustrated cylindrical portion 22.

Those of ordinary skill in the art will readily understand that the flanges 48 and the lips 50 can be formed integrally with the panel 38. As illustrated in FIG. 4, the panel 38, the ventilation apertures 30, the mounting slots 52 and the mounting holes 54 are cut from a relatively flat sheet of material, such as a sheet of stainless steel or steel. The flat sheet can then be bent as required to form the flanges 48 and the lips 50. In the illustrated embodiment, the bends that form the flanges 48 and the lips 50 are in the same direction. However, other methods for forming the panels 38, including bending the flat sheet in different directions, or attaching the flanges 48 and lips 50 separately, can also be successfully used. In the illustrated embodiment, the flanges 48 and the lips 50, like the rest of the panel 38, have ventilation apertures 58 formed therein.

Figure 5:
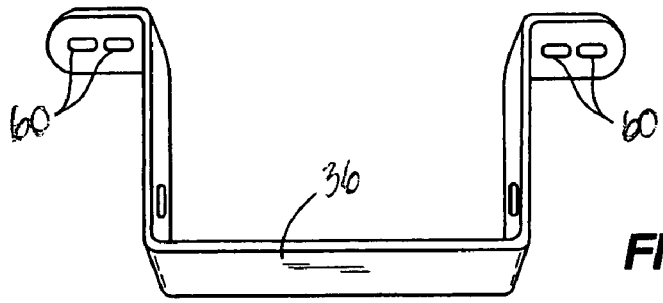
FIG. 5 is a perspective view of a handle for the burning container illustrated in FIG. 1.

Referring also to FIGS. 1 and 5, the handle 36 is secured to the cylindrical portion 22 by extending fasteners (e.g., the self-tapping fasteners 56 described above) through apertures 60 in the handles 36 and through the mounting slots 52 and mounting holes 54 of the panels 38. In another embodiment, the handle 36 is mounted to the chamber panel 38 through apertures 30.

Figure 6:
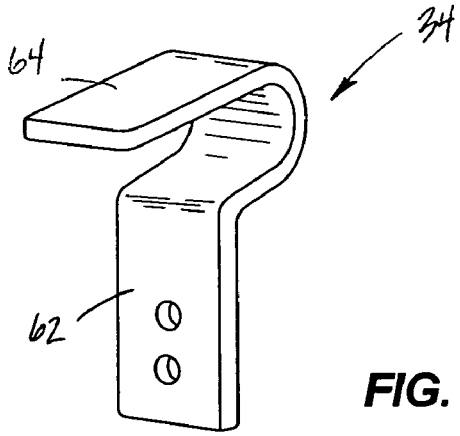
FIG. 6 is a perspective view of a cover hook for the burning container illustrated in FIG. 1.

Referring to FIGS. 1 and 6, the cover hooks 34, or clips, are secured to the cylindrical portion 22 in a similar manner. In the illustrated embodiment, three cover hooks 34 are attached to the top edges 40 of the panels 38, and the cover hooks 34 are angularly spaced from one another by approximately 90 degrees. Each cover hook 34 includes a mounting portion 62 that is secured to one of the panels 38, and a U-shaped portion 64 that extends over the top edge 40 of the panels 38. The cover 32 is configured and adapted to overlap the top edges 40 of the assembled cylindrical portion 22 and is received by the U-shaped portions 64 of the cover hooks 34, whereby the cover hooks 34 support the cover 32. In further embodiments, fewer or more cover hooks may be used to attach the cover, and the cover hooks may be spaced greater or lesser distances apart.

Figure 7A:
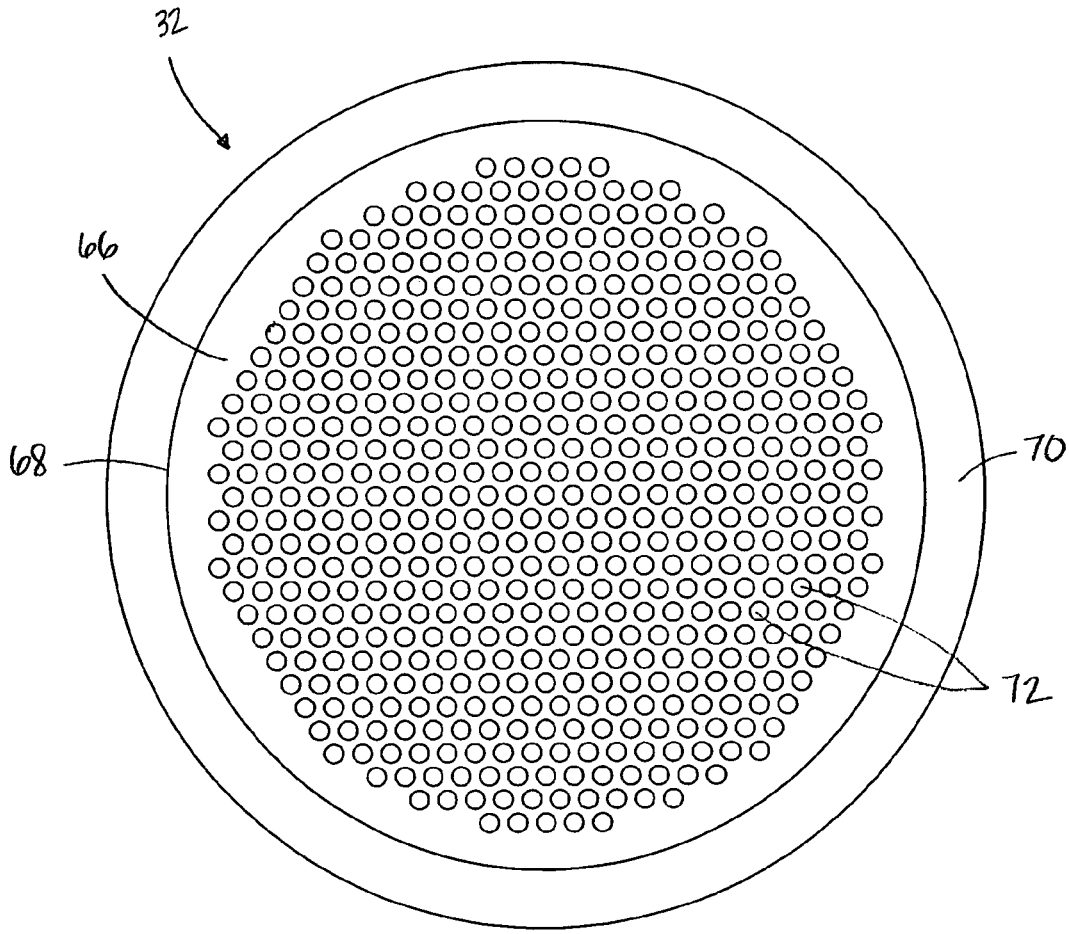
FIG. 7A is a top view of a cover for the burning container illustrated in FIG. 1.
Figure 7B:
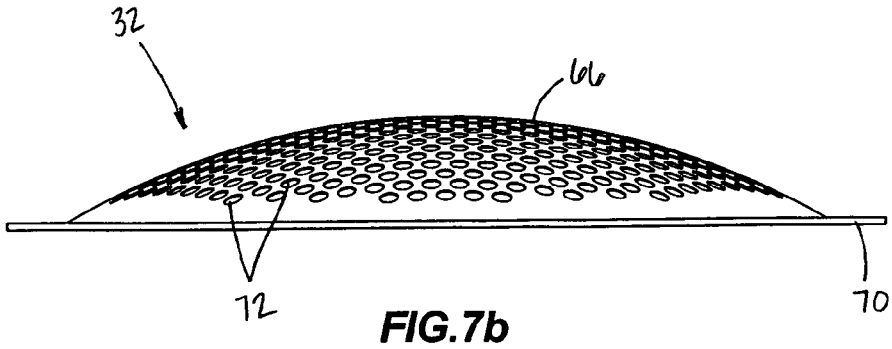
FIG. 7B is a side view of the cover illustrated in FIG. 7A.

FIGS. 1, 7A and 7B illustrate the cover 32 of the burning container 20, which when supported by the cylindrical portion 22 operates as a grill, ventilation means or a spark arrestor for the burning container 20. The cover 32 includes a central, convex portion 66 having a peripheral edge 68, and a flange portion 70 extending radially outward from the peripheral edge 68. A plurality of apertures 72 are formed in the convex portion 66 of the cover 32 for providing ventilation to the burning chamber 26 while preventing sparks, large pieces of ash, and burning debris from exiting the burning chamber 26.

In use, the cover 32 is supported by the cylindrical portion 22 by sliding the flange portion 70 into and out of position within the U-shaped portions 64 of the cover hooks 34. In the embodiment illustrated in FIG. 1, the cover 32 is positioned such that the convex portion 66 extends into the burning chamber 26. In this configuration, the cover 32 may be used as a grill with food placed on a concave surface of the cover 32. In another embodiment, the cover 32 is positioned such that the convex portion extends opposite the burning chamber 26. In this configuration, the cover 32 is operable as a spark arrestor. In yet another embodiment, a flange extends axially outwardly from an outer edge of the flange portion 70 and away from the convex portion 66 to provide additional stiffness to the cover 32.

Figure 8:
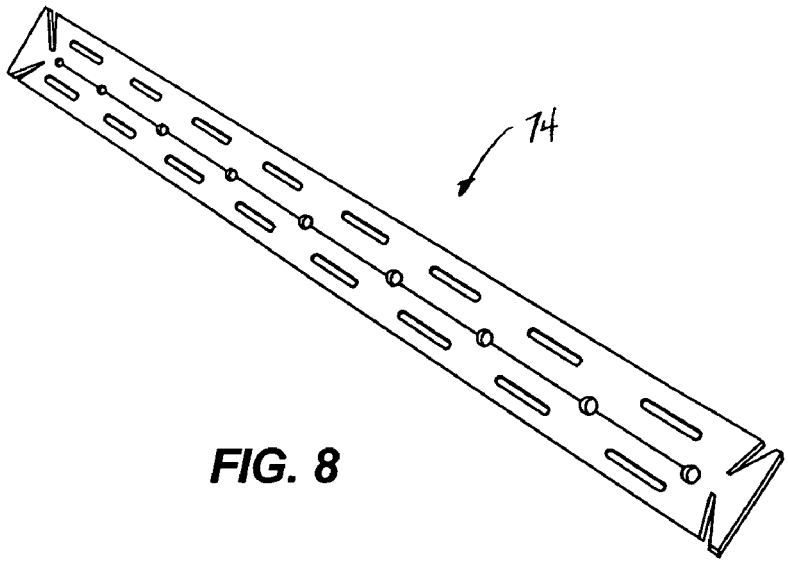
FIG. 8 is a perspective view of a cross bar for the burning container illustrated in FIG. 1.

Referring to FIGS. 2 and 8, a pair of cross bars 74 having a generally V-shaped cross-section are configured to at least partially support burning material inserted into the burning chamber 26. The cross bars 74 are inserted into generally V-shaped support apertures 76 formed in the panels 38 (shown in FIGS. 1 and 4). Each cross bar 74 extends generally diametrically across the cylindrical portion 22 and is supported on each end by one of the panels 38. Preferably, the cross bars 74 are inserted such that the V-shaped cross-section points generally upwardly and such that the cross bars 74 are at an angle of approximately 90 degrees to each other when viewed along the central axis 24.

Figure 9:
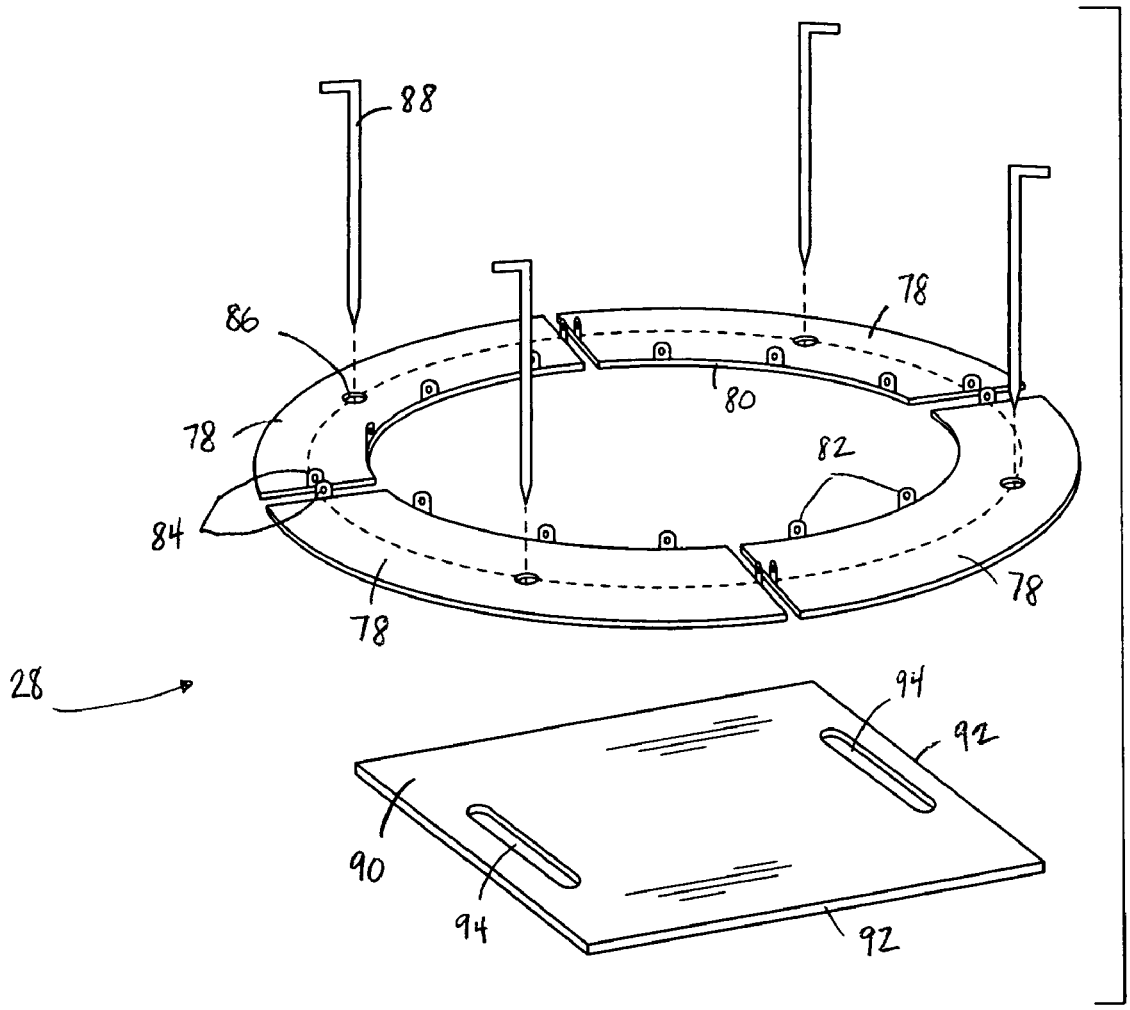
FIG. 9 is an exploded view of a base assembly for the burning container illustrated in FIG. 1.

Referring to FIG. 9, the base assembly 28 includes four arc-shaped portions 78 that are preferably formed from a relatively flat sheet of metal. Each arc-shaped portion 78 includes an inner edge 80 along which is formed a plurality of longitudinally extending mounting tabs 82. In some embodiments, the mounting tabs 82 are formed integrally with the arc-shaped portions 78 and are bent generally upwardly to receive the cylindrical portion 22. As illustrated, the mounting tabs 82 engage the outside surfaces of the panels 38 and are secured thereto using fasteners, such as the self-tapping fasteners 56 described above. In the illustrated embodiment, the arc-shaped portions 78 attach to the outside surfaces of the panels 38 so that ash is permitted to fall through the burning chamber 26 to the ground. Each arc-shaped portion 78 also includes a pair of coupling tabs 84. The coupling tabs 84 are provided such that four arc-shaped portions 78 are securable to one another to define a generally annular support ring.

When the burning container 20 is fully assembled, the bottom edges 42 of the panels 38 rest upon the arc-shaped portions 78 between the inner edges 80 and the mounting tabs 82. The arc-shaped portions 78 also include grounding apertures 86 that are spaced along the annular ring. The grounding apertures 86 receive stakes 88 that are insertable into the ground to secure the base assembly 28 and the cylindrical portion 22. It should be readily apparent to one skilled in the art that the support ring can be formed of fewer or more portions, including a one-piece ring.

In FIG. 9, the base assembly 28 also includes a base plate 90. In the illustrated embodiment, the base plate 90 is generally rectangular and includes sides 92 having a length that is longer than an inner diameter of the support ring, but smaller than an outer diameter of the support ring. In this way, the base plate 90 substantially completely overlies a bottom portion of the burning chamber 26, but does not extend so far as to prevent the insertion of stakes 88 through the grounding apertures 86. The base plate 90 also includes a pair of slots 94 that define handles. The base plate 90 affords easy collection and disposal of ash, as discussed further below. In a further embodiment, the base assembly 28 does not include the base plate 90.

The burning container 20 can be assembled from the various components by coupling the free edge 44 of a first panel 38 to the flange edge 46 of a second panel 38. Additional panels 38 are then coupled to the first and second panels 38 in a similar manner until a complete cylinder is formed, thereby defining the cylindrical portion 22, the central axis 24 and the burning chamber 26. As the panels 38 are coupled together, the flanges 48 are positioned to extend radially inward with respect to the central axis 24. The cover hooks 34 and the handle 36 are attached to the panels 38 using the mounting slots 52 and mounting holes 54 of the panels 38, although other apertures for securing the cover hooks 34 and the handle 36 may be used. The assembled cylindrical portion 22 is then secured to the base assembly 28. The cross bars 74 are inserted through the support apertures 76 and the cover 32 is then positioned on the top edges 40 to overlie the burning chamber 26.

In operation, the burning container 20 is preferably positioned on relatively soft ground such as sand or dirt. The stakes 88 are inserted into the ground to secure the base assembly 28 and the cylindrical portion 22 against undesired movement or overturning. Burnable material, such as paper, wood, yard refuse, coals, hickory or the like, are positioned inside the burning chamber 26. The burnable material is supported at least partially by the cross bars 74, and may also rest on the base plate 90 or the ground. The burnable material is supported along the sides of the burning chamber 26 at least partially by the inwardly extending flanges 48 and the circumferentially extending lips 50.

The flanges 48 and the lips 50 cooperate to provide a chimney-like air flow passageway 96 that keeps burning material away from the panels 38 in the area of the flanges 48 and that allows air to flow along the sides of the burning chamber 26 in the direction shown by arrow 98 in FIG. 4. As can be seen in FIG. 2, the panels 38 define a first outer diameter and the lips 50 define a second inner diameter, whereby the air flow passageways 96 are defined between the first and second diameters. It should be readily apparent to those of skill in the art that air flows in direction 98 within and outside of air flow passageways 96. Further, ventilation apertures 58 formed in the flanges 48 and the lips 50 that define the air flow passageways 96 afford air flow into the burning chamber 26 transverse to the central axis 24, as shown by arrow 100 in FIGS. 2 and 3. The flanges 48 also assist in preventing burning material from overlying the ventilation apertures 30 to further improve air flow through the burning chamber 26. In a further embodiment, the specific size and configuration of the flanges 48 and the lips 50 may be modified to achieve certain desired burning characteristics.

Preferably, the cover 32 is positioned over the burning chamber 26 and the burnable material is ignited through any of the ventilation apertures 30. Alternatively, the burnable material may be ignited from the top, before the cover 32 is positioned within the U-shaped portions 64 of the cover hooks 34. As the burnable material burns, air is drawn into the burning chamber 26 through the ventilation apertures 30, and air flows generally upwardly through the air flow passageways 96 defined by the flanges 48 and lips 50 before exiting through the apertures 72 in the cover 32. The sizing and positioning of the ventilation apertures 30 and the cover apertures 72 are such that large pieces of ash and/or debris are substantially prevented from leaving the burning chamber 26, while a substantial amount of air flow is maintained through the burning chamber 26. When the burnable material has completely burned and the burning container 20 has cooled, the stakes 88 are removed from the base assembly 28 and the cylindrical portion 22 and arc-shaped portions 78 are lifted or rolled away from the base plate 90, leaving a pile of ashes on the base plate 90. The base plate handles 94 may then be used to carry the base plate 90 and the pile of ashes to an appropriate container for disposal.

Figure 10:
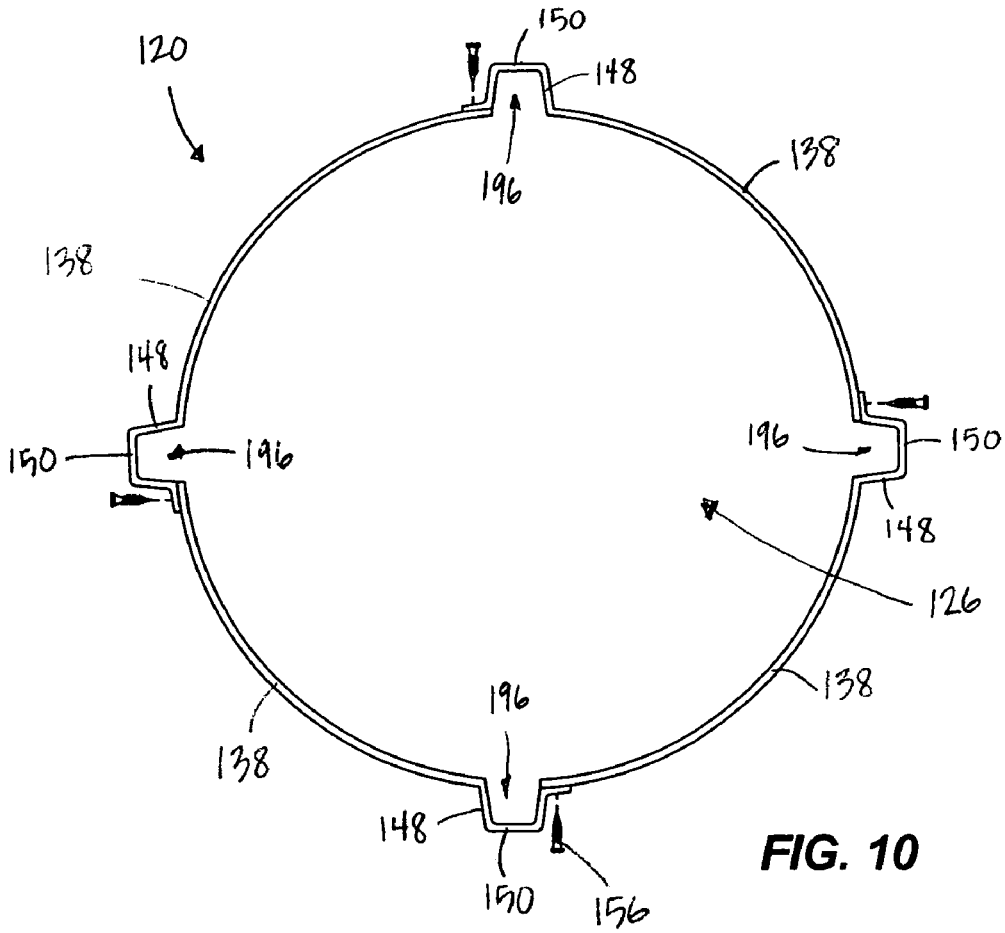
FIG. 10 is a section view similar to FIG. 3 illustrating a container which is an alternative embodiment of the invention.

FIG. 10 illustrates an alternative embodiment of a burning container 120. Features and components of the burning container 120 that are the same or similar to features and components of the burning container 20 have been given like reference numerals, increased by one-hundred. The burning container 120 is similar to the container 20, however the flanges 148 of the panels 138 extend radially outward, as opposed to radially inward. The lips 150 extend circumferentially from the ends of the flanges 148 and are coupled to an adjacent panel 138. The air flow passageways 196 of the container 120 extend along the burning chamber 126 in a similar manner as the air flow passageways 96, but are positioned radially outward with respect to the panels 138. Other orientations and configurations of the panels, flanges, lips, and passageways are possible as well.

Various features of the invention are set forth in the following claims.

The invention claimed is:

1. A burning device comprising:

a plurality of interconnected chamber walls defining a burning chamber and a central axis, each chamber wall also defining a plurality of chamber apertures;

a plurality of flanges extending radially from the chamber walls and substantially parallel to the central axis;

a plurality of circumferentially extending lips, each of the plurality of lips extending from a respective flange, each lip being radially spaced apart from an associated chamber wall and defining therebetween an air flow passageway communicating with the burning chamber and affording air flow into the burning chamber;

ventilation apertures defined in at least one of the plurality of lips and the plurality of flanges, the ventilation apertures providing communication between the air flow passageways and the burning chamber; and a cover removably supported by the chamber walls and defining a plurality of apertures.

2. The burning device of claim 1 wherein the cover includes a convex portion that has the plurality of apertures and a flange portion extending radially outward from a peripheral edge of the convex portion.

3. The burning device of claim 2 wherein the flange portion is removably supported by the chamber walls.

4. The burning device of claim 2 wherein the cover is removably support by the chamber walls in a first position, in which the convex portion extends into the burning chamber, and second position, in which the convex portion extends opposite the burning chamber.

5. The burning device of claim 1, and further comprising at least one hook coupled to a top edge of one of the plurality of chamber walls wherein the at least one hook removably supports the cover.

6. The burning device of claim 1 wherein the chamber walls include a top edge and further wherein a top edge of at least one of the plurality of flanges and the respective lip is recessed from the top edge of the chamber walls.

7. The burning device of claim 1, and further comprising a support ring removable securable to bottom edges of the chamber walls wherein the support ring is comprised of a plurality of portions.

8. A method for assembling a burning device comprising:

forming a plurality of chamber panels, each being similarly formed to include a top edge, a bottom edge, a free edge, a flange edge, and a flange extending from the flange edge, at least one chamber panel defining a plurality of apertures;

coupling the free edge of a first chamber panel to the flange edge of a second chamber panel;

coupling additional chamber panels to the first and second panels as needed to define a burning chamber having a central axis;

providing a generally annular support ring that is securable to the ground;

coupling the bottom edges to the support ring; and positioning a cover defining a plurality of apertures on the top edges of the panels to overlie the chamber wherein the cover is positionable with respect to the panels in more than one position.

9. The method of claim 8, and further comprising positioning the cover such that a convex portion of the cover defining the plurality of cover apertures extends into the burning chamber.

10. The method of claim 8, and further comprising positioning the cover such that a convex portion of the cover defining the plurality of cover apertures extends opposite the burning chamber.

11. The method of claim 8 wherein positioning the cover comprises positioning an outer peripheral edge of the cover within at least one hook coupled to the top edge of at least one panel, wherein the at least one hook removably supports the cover.

* * * * *